United States Patent [19]

Lee

[11] 4,211,464

[45] Jul. 8, 1980

[54] ELECTRIC OUTLET BOX CONTAINING TWIN ELECTRIC SOCKETS

[76] Inventor: Hop Lee, 2455 - 24th Ave., San Francisco, Calif. 94116

[21] Appl. No.: 32,545

[22] Filed: Apr. 23, 1979

[51] Int. Cl.[2] ..... H01R 9/16

[52] U.S. Cl. ..... 339/122 R; 174/53; 339/191 R

[58] Field of Search ..... 339/122, 59 R, 191, 339/192, 206, 95 R, 244, 192 R, 191 R, 191 A, 191 M, 206 R, 206 L, 206 P; 174/53, 54

[56] References Cited

U.S. PATENT DOCUMENTS

| | | | |
|---|---|---|---|
| 1,675,016 | 6/1928 | Alpaugh | 339/191 R |
| 3,038,141 | 6/1962 | Chiuchiolo | 339/122 |
| 3,187,084 | 6/1965 | Stillman et al. | 174/53 |

FOREIGN PATENT DOCUMENTS

| | | | |
|---|---|---|---|
| 884031 | 10/1971 | Canada | 339/122 |

*Primary Examiner*—John McQuade

*Attorney, Agent, or Firm*—Alvin E. Hendricson; William R. Piper

[57] ABSTRACT

An electric outlet box containing twin electric sockets in which each socket has electrodes and means for clamping the bare wire strands of the wires into electrical contact with their associate electrode. Also, the wire clamping means includes socket positioning pins mounted in the electric box and these pins are received in bores provided in extensions on the members that clamp the bare wire strands to the electrodes. The extensions contact a wall of the box that supports the pins and the cover for the box contacts the twin sockets and forces them against the same box wall and in this manner the twin sockets are secured in place and at the same time the bare wire strands are clamped in electrical contact with their associate electrode.

2 Claims, 6 Drawing Figures

FIG. 4-A.

ELECTRIC OUTLET BOX CONTAINING TWIN ELECTRIC SOCKETS

SUMMARY OF THE INVENTION

An object of the invention is to provide an electric outlet box rectangular in shape and that has a snap-on cover for closing the box. Novel means is used for positioning and supporting the twin electric sockets in the box and for registering the two ends of the electrode receiving recesses of the twin sockets with the openings in the cover. Also, novel means is used for securing wire carrying cables to both ends of the box and clamping them in place.

BRIEF DESCRIPTION OF THE DRAWINGS

FIG. 4A, is a section taken along the line 4A—4A of FIG. 4.

DESCRIPTION OF THE PREFERRED EMBODIMENT

Figure 1:
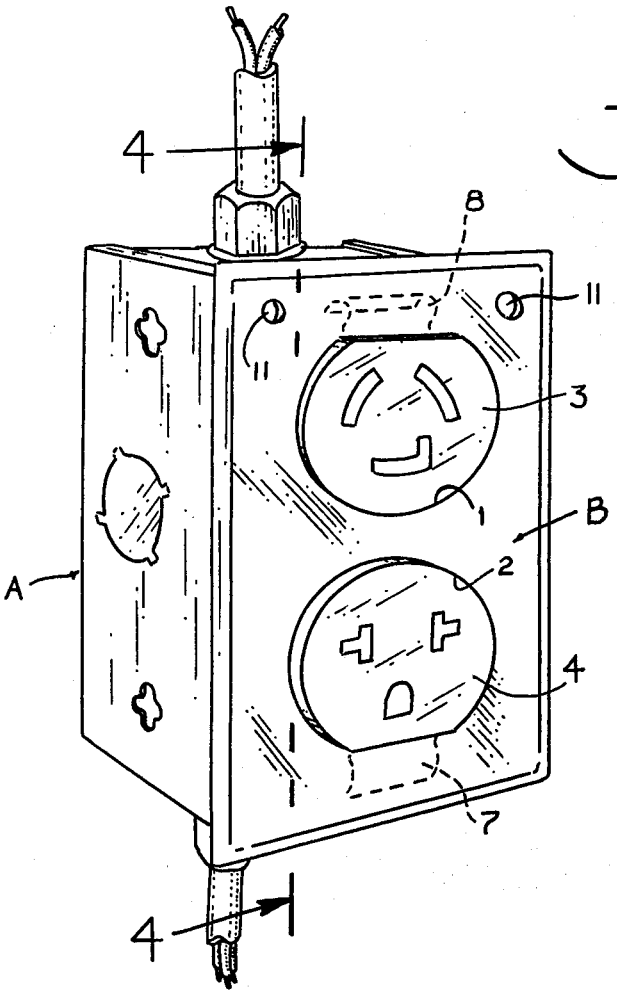
FIG. 1 is a perspective view of the electric outlet box.
Figure 3:
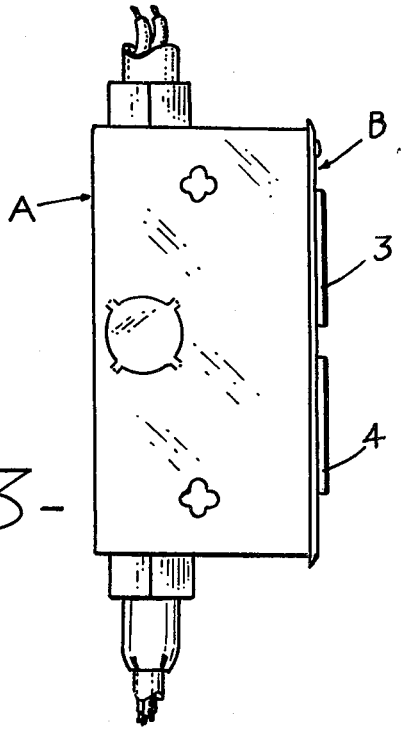
FIG. 3 is a side elevation of the box and illustrates the side opposite from the one shown in FIG. 1.
Figure 4:
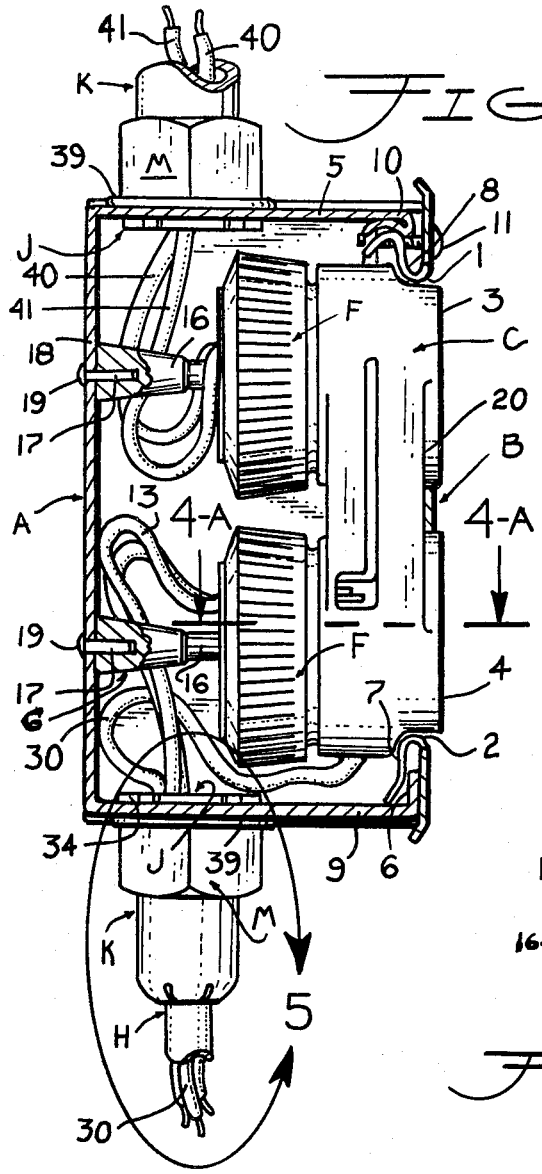
FIG. 4 is a larger view showing the box and cover in section and illustrating how the twin electric sockets are rigidly mounted in the box. A portion of one of the twin sockets is shown in section to illustrate one of the wires and how its bare metal strands are clamped against its associate electrode, this being accomplished without the need of a set screw around which the bare wire strands are usually wrapped.

In carrying out my invention I provide an electric box A which is in the shape of a prism. A rectangular cover B encloses the open top of the box, see FIGS. 1, 3 and 4. This cover has two openings 1 and 2 shaped for receiving the outlet portions 3 and 4 of a twin socket mounting C. The box A has an end wall 5 with an inwardly extending flange 6, as shown in FIG. 4. The cover B has an itegral U-shaped clip 7 extending inwardly from a rim portion of the opening 2 and the clip receives the flange 6 to secure the cover in closed position on the box. It will further be seen from FIG. 4 that the box cover has an integral spring clip 8 that extends inwardly from a rim portion of the opening 1. The wall 5 of the box has an inwardly bent part 10 that has a groove therein for receiving the spring clip 8 when the cover B, is in closed position on the box. In addition, the cover may be secured in place by screws 11, see FIG. 1, these screws being received in threaded bores, not shown, in the box.

The twin socket mounting C, is anchored within the box by novel means shown in FIG. 4. This novel means also forces the bare metal strands of the various wires into clamping and electrical connections with their associate electrodes. I have shown only one such connection in FIG. 4A as an example.

One of the electrical sockets in the twin socket C, is shown partially in section in FIG. 4A to illustrate one of the electrodes D, and how it is electrically connected to the bare wire strands 12 of one of the wires 13. The electric socket E has an exteriorly threaded cylindrical portion 14 for receiving a cap F. A wire supporting member G has a base 15 with a cylindrical periphery designed to be received within the hollow interior of the electric socket E, as shown in FIG. 4A. The base 15 has a bore for receiving the bare wire strands 12 and the portion of these strands extending beyond the bore are bent backward and are forced into a clamping electrical contact with the electrode D by the electric socket E. The cap F when screwed onto the threaded portion 14, will bear against the base 15 causing the base to clamp the bare wire strands against the electrode D.

FIGS. 4 and 4A further show the wire supporting member G, as having an axial projection 16 with an axial bore 17 therein. The bottom 18 of the box A, has a pin 19 which enters the bore 17 in the projection 16 for properly positioning the twin socket mounting C within the box. There are two pins 19 and they both are received in the bores 17 in the projections 16 when the twin socket mounting is placed in the box A. It will be seen from this arrangement of parts that when the box cover B is secured in place, it will press against the adjacent surface 20 of the twin socket mounting C and force the mounting and the projections 16 against the rear box wall 18. In this way the different parts are interlocked with each other and the wire supporting members G will have their bases 15 clamp the bare wire strands 12 into electrical contact with the electrode D. This electrode is designed to receive an electrode, not shown, of a plug in electrical member, not shown. FIG. 4 shows several wires similar to the wire 13 connected to the two wire supporting members G, and the bare wire strands of these wires are held in electrical binding arrangement with their respective electrodes in the same manner as described for the wire 13, bare wire strands 12 and electrode D. This is one of the novel features of my invention.

Figure 5:
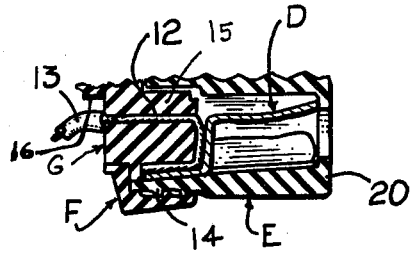
FIG. 5 is an exploded perspective view illustrating the means for clamping and securing a wire carrying cable to the box and permit the wires in the cable to enter the box and be connected to the twin sockets.
Figure 5:
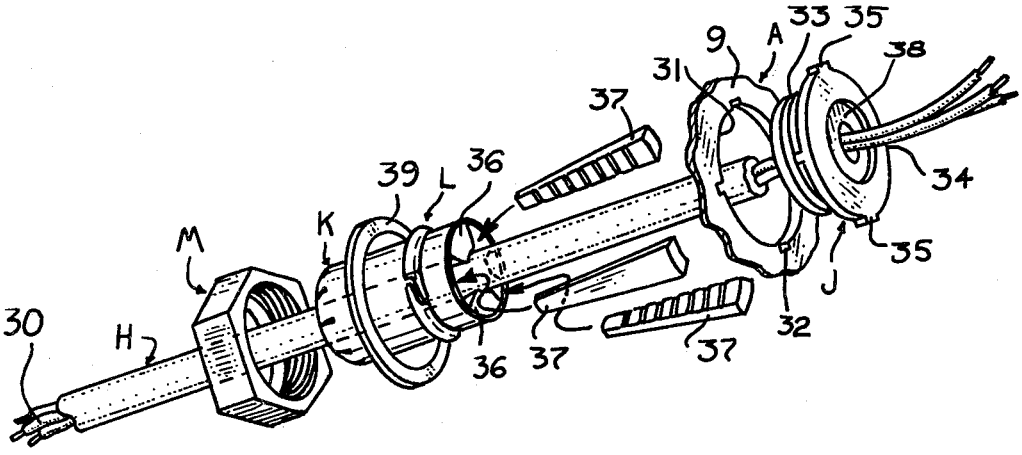

Another novel feature of applicant's invention is the manner of connecting the wire carrying cable H to the end wall 9 of the box A, see FIG. 4, and the exploded view of FIG. 5. The cable H contains three wires, one of which is a "ground" wire 30. In the exploded view of FIG. 5, a portion of the box end wall 9 is shown as having an opening 31 with recesses 32 in its rim. A nut J has an exteriorly threaded cylindrical portion 33 receivable in the wall opening 31. The nut has an annular flange 34 with projections 35 receivable in the recesses 32 so that the nut when received in the opening is anchored against any rotation in the opening.

A sleeve K receives the cable H, and on its inner surface is provided with longitudinally extending ribs 36 that are angularly spaced apart from each other. I provide three wedgeshaped members 37 which are receivable in the spaces between adjacent ribs 36 and when the wedges are mounted in position they will grip the cable to anchor the sleeve to the cable. The end of the cable covering H terminates at the end of the sleeve which receives the wedges 37. FIG. 4 shows the annular flange 34 of the nut J bearing against the inner surface of the box wall 9. This will cause the threaded cylindrical portion 33 of the nut to extend through the wall opening 31.

When now the cable H is inserted into the sleeve K and is clamped in place by the wedges 37, the end of the cable covering will lie flush with the end of the sleeve K that has the wedges and it is this end which will abut an inwardly extending annular flange 38 on the nut and permit only the three wires in the cable to extend into the interior of the box A where they are connected to the one of the two sockets in the twin socket mounting C. FIG. 5 shows a collapsible resilient split ring L, mounted on the sleeve K, and this ring will bear against the end of the threaded cylindrical portion 33 of the nut J when the parts are assembled. A washer 39 is placed against the outer surface of the box wall 9 and a coupling nut M slides over the sleeve K, and is screwed upon the threaded portion 33 of the nut J that projects through the box wall opening 31. The coupling nut M contacts the washer 39 and in this manner the cable H, is secured to the box and only the three cable wires extend into the box.

Figure 2:
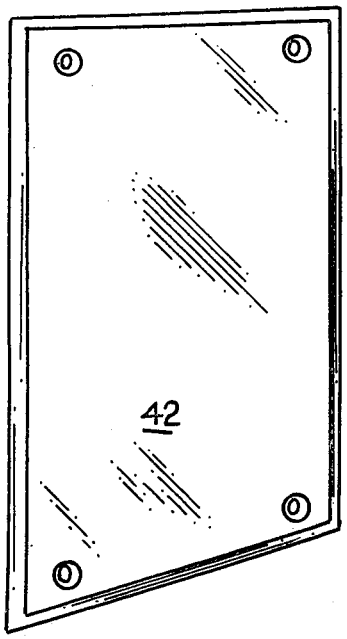
FIG. 2 is a perspective view of a box cover securable to the box when the box does not contain the twin electric sockets.

The cable H contains three wires, one of these being the "ground" wire 30. The "ground" wire in the cable H is connected to a "ground", not shown, associated with the source of electricity, not shown. It is possible to have only two electric wires, instead of three wires, lead from the twin socket mounting C to another electrical fixture, not shown. I have therefore shown in FIG. 4 two wires 40 and 41 leading from the twin socket mounting C, and being enclosed in a second cable, not shown. The cable mounting means for the second cable is identical to that described in FIG. 5. Corresponding parts of the two cable mounting means shown in FIG. 4, will be given similar reference characters and no further detailed description need be given. FIG. 2 shows a blank cover 42 that can be used instead of the cover B when the box A is not provided with the twin socket mounting C.

I claim:

1. An electric outlet box comprising:

(a) a box having a bottom wall with pins extending into the box for positioning a twin socket mounting received in the box;

(b) each socket in the mounting supporting a plurality of electrodes and a wire supporting member removably receivable in each socket, each member having a base with bores for receiving the bare wire strands of the wires and the portions of the wire strands extending beyond the bores contacting the base and being forced into electrical connection with their associate electrode when the wire supporting member is received in the socket;

(c) each wire supporting member having an extension with a bore therein for receiving the socket positioning pin when the twin socket mounting is mounted in the box; and (d) a cover for closing the box, said cover pressing against said twin socket mounting for forcing the extensions of the wire supporting members against the box bottom wall for positioning and anchoring the mounting in the box, the bases of said members being forced into positions for clamping the bare wire strands to their associate electrodes for forming an electrical connection therewith.

2. The combination as set forth in claim 1: and in which (a) caps having cylindrical portions internally threaded are connectible to threaded portions on each socket for mounting said wire supporting members in their associate socket.

* * * * *